United States Patent [19]

Pohlenz

[11] Patent Number: 4,658,976

[45] Date of Patent: Apr. 21, 1987

[54] LINED PLASTIC CLOSURE

[75] Inventor: Elmer E. Pohlenz, Richmond, Ind.

[73] Assignee: Aluminum Company of America, Pittsburgh, Pa.

[21] Appl. No.: 687,505

[22] Filed: Jan. 4, 1985

Related U.S. Application Data

[63] Continuation of Ser. No. 485,277, Apr. 15, 1983, abandoned.

[51] Int. Cl.[4] ..... B65D 53/04

[52] U.S. Cl. ..... 215/252; 215/349

[58] Field of Search ..... 215/349, 350, 351, 252

[56] References Cited

U.S. PATENT DOCUMENTS

| | | | |
|---|---|---|---|
| 910,128 | 1/1909 | Hammer . | |
| 1,978,946 | 10/1934 | Horner . | |
| 2,130,749 | 9/1938 | Von Till . | |
| 2,409,789 | 10/1946 | Osborne | 226/84 |
| 2,550,586 | 4/1951 | Nardone | 215/350 X |
| 3,055,526 | 9/1962 | Plunkett | 215/41 |
| 3,160,303 | 12/1964 | Healy | 215/41 |
| 3,209,934 | 10/1965 | Salminen | 215/41 |
| 3,219,222 | 11/1965 | Davidson | 215/350 X |
| 3,232,470 | 2/1966 | Gibson | 215/43 |
| 3,303,955 | 2/1967 | Osborne et al. | 215/39 |
| 3,331,523 | 7/1967 | Exton . | |
| 3,433,380 | 3/1969 | Kawchitch | 215/40 |
| 3,462,035 | 8/1969 | Grussen | 215/41 |
| 3,480,170 | 11/1969 | Evans et al. . | |
| 3,595,419 | 7/1971 | Dukess . | |
| 3,868,038 | 2/1975 | Hadley | 215/305 |
| 4,261,475 | 4/1981 | Babiol | 215/341 |
| 4,308,965 | 1/1982 | Dutt | 215/345 |
| 4,322,011 | 3/1982 | Mumford | 215/270 |
| 4,381,840 | 5/1983 | Ostrowsky | 215/329 |
| 4,462,502 | 7/1984 | Luenser et al. | 215/329 |

FOREIGN PATENT DOCUMENTS

| | | | |
|---|---|---|---|
| 14100/76 | 11/1977 | Australia . | |
| 459783 | 9/1949 | Canada | 215/350 |
| 463296 | 2/1950 | Canada | 215/349 |
| 2443393 | 7/1980 | France . | |
| 81/00838 | 4/1981 | World Int. Prop. O. . | |
| 683521 | 12/1952 | United Kingdom . | |
| 952962 | 3/1964 | United Kingdom . | |
| 975739 | 11/1964 | United Kingdom . | |

OTHER PUBLICATIONS

Modern Plastics Encyclopedia, 1981–1982, pp. 483 to 485.

*Primary Examiner*—Donald F. Norton
*Attorney, Agent, or Firm*—Thomas J. Connelly

[57] ABSTRACT

A plastic closure having a plastic liner disposed therein is adapted to assemble with a container and provide a side seal and a top seal between the closure and the container wall adjacent the container mouth. The closure includes a plastic cap having an annular ledge near the junction of the cap top wall and skirt. Downward linear movement of the closure relative to the bottle during assembly of the closure with the bottle irons a marginal portion of the liner adjacent the liner edge between the annular ledge of the cap and the outer rim edge of the bottle wall surrounding the bottle mouth, and a side seal between the closure and bottle wall surrounding the bottle mouth is provided thereby. A top seal between the closure and rim of the wall surrounding the bottle mouth is also effected by compressing a portion of the liner therebetween.

27 Claims, 6 Drawing Figures

LINED PLASTIC CLOSURE

This application is a continuation of application Ser. No. 485,277, filed Apr. 15, 1983 and now abandoned.

BACKGROUND OF THE INVENTION

This invention relates to providing a side seal between a plastic closure and a bottle and, more specifically, to providing a side seal by ironing a marginal portion of a liner adjacent the liner edge while assembling a closure with a bottle.

Plastic closures have become increasingly popular for use in a wide variety of packaging applications because of certain inherent characteristics of plastic materials. For example, plastics demonstrate relatively good corrosion resistance in diverse environments; plastics are capable of being molded into intricate shapes; and plastic closures can be made to offer aesthetic appeal to the consumer.

A potentially very large market for plastic closures which has developed only minimal usage to date, however, is in packaging carbonated beverages. Carbonated beverages packaged in glass or plastic bottles are, for the most part, confined within the bottle by a metal closure having a plastic liner therein. An early patent, Hammer U.S. Pat. No. 910,128, describes one type of a metal closure having a packing disc therein which provides both a side seal and top seal when applied to a threaded container. The closure described in Hammer is preformed before assembly with the container; that is, the structure of the closure is completely formed prior to assembling the closure with the container. During application of the closure, a peripheral portion of the packing disc is bent around the outer side of the mouth of the container and compressed against the container wall to provide a side seal. The end panel compresses the disc against the top of the mouth of the container to also effect a top seal.

Further developments of metal closures for sealing carbonated beverages are described in patents such as Osborne et al U.S. Pat. No. 3,303,955 and Hadley U.S. Pat. No. 3,868,038. In these patents a metal closure blank having a liner laminated to the end wall thereof is provided and the closure is engaged with a threaded bottle by deforming the skirt with a roller to conform to the bottle thread. Prior to rolling the thread in the skirt, a pressure block adapted to deform an end wall portion of the blank is axially applied to the blank and deforms a peripheral portion of the end wall to bend it around the mouth of the closure and thus compress the liner against both the top of the bottle mouth and the outer surface adjacent the mouth to effect both a top seal and side seal.

Plastic closures have not been widely used to package carbonated beverages primarily because of the problem of maintaining an effective seal between the closure and the container due to the internal pressure within the sealed container from gas escaping from the carbonated beverage.

When plastic materials are subjected to a stress over any extended period of time, they have a tendency to creep or cold flow. This tendency is exacerbated if the plastic is exposed to elevated temperatures. In packaging carbonated beverages, therefore, the shelf life of a beverage sealed in a bottle with a plastic closure is of greater concern than if the beverage is packaged by using a metal closure to effect a seal. Manufacturing tolerances of commercial bottles have also presented problems in the use of plastic closures. Relatively speaking, the manufacturing tolerances in making a conventional glass bottle are large, and fabrication of a molded plastic closure to accommodate the wide range of diameters encountered in a given bottle size and still maintain an effective seal has been a major problem for plastic closure manufacturers.

To solve these problems a number of solutions have been proposed. For example, Plunkett U.S. Pat. No. 3,055,526, Healy U.S. Pat. No. 3,160,303 and Gibson U.S. Pat. No. 3,232,470 feature linerless closure structures which rely upon a compressive seal on the rim face of the container. Mumford U.S. Pat. No. 4,322,011 provides a side sealing rib on the skirt wall of the closure in addition to a top seal to improve the seal reliability. Another approach has been to provide a plug-type structure which provides a seal, at least in part, from the interaction between the plug and the inner surface of the container neck. Examples of closures of this kind are described in Grussen U.S. Pat. No. 3,462,035 and Salminen U.S. Pat. No. 3,209,934.

A plastic cap having a separate liner contained therein is described in Evans et al U.S. Pat. No. 3,480,170 and sealing is effected simply by compressing the liner which is positioned adjacent the under surface of the top wall of the cap against the container mouth.

Primarily because of the loss of an effective seal after packaging, plastic carbonated beverage closures have not gained widespread acceptance in the industry in spite of the many efforts to develop a plastic closure for such use.

Accordingly, a plastic beverage closure is desired that can be used to package carbonated beverages in either a glass or plastic bottle and retain an effective seal over extended periods of time.

SUMMARY OF THE INVENTION

The present invention provides a plastic cap which is adapted to thin and elongate a peripheral portion adjacent the edge of a plastic liner disposed within the cap by ironing such portion while engaging the cap with a container. The ironed portion of the liner functions to provide an improved side seal over side seals obtained heretofore between the container and cap because ironing of the liner forces the liner to fill irregular gaps between the closure and container due to manufacturing tolerance variables and also better fill container surface flaws and defects. A top seal is provided by a portion of the liner which is compressed between the cap and the rim around the container mouth.

By ironing is meant the process whereby a material is reduced in wall thickness and elongated by squeezing the material between spaced apart tools that are adapted for linear movement relative to each other. A well-known example of the use of ironing is in making thin wall beverage cans. Typically in making such a can, a metal blank is first drawn into a cup having an essentially uniform wall thickness throughout by positioning a metal blank over a circular die opening and pressing the blank through the die with a cylindrical mandrel moving therethrough. The diameters of the mandrel and die relative to one another are sufficient to permit forming the cup with essentially no thinning or reduction in thickness of the metal. To iron or thin the side wall of the cup, the mandrel having the cup mounted thereon is passed through one or more tools known as ironing rings, each ring having a less inside diameter than the preceding draw die or ring. Thus, the first ironing ring having a lesser inside diameter than the inside diameter of the draw die causes the side wall of the cup to be thinned and elongated as it is forced through the ironing ring by the mandrel. Successive thinning and elongation of the side wall is made by forcing the cup workpiece through successive ironing rings of lesser diameter until the desired thickness and length of the finished can body is attained.

In a closure of this invention, an annular shoulder near the junction of the top wall and the skirt wall of the cap projects radially inward and functions in a manner similar to an ironing ring, as just discussed. A plastic liner is disposed within a portion of the cap between the shoulder and means for engaging the container, such as a spiral thread, for example. The diameter of the liner is preferably sufficient to create an interference fit between the liner and the cap skirt wall to maintain an assembly of the liner in the cap until the cap is assembled with the bottle. If desired, the closure may also include a tamper-evident means extending downward from the skirt wall.

When the closure, comprised of the cap having the liner disposed therein, is assembled with a container by engaging the cap with the container, the interaction between a cylindrical sealing surface on the container neck adjacent the container mouth and the cap shoulder causes a marginal portion of the liner adjacent the liner edge to be ironed; that is, such portion is thinned and elongated, and in the process thereof the thinned portion of the liner is forced into tight contact with side sealing surfaces of the cap and the container. In addition, a top seal is provided by compression of a top portion of the liner between the annular top surface of the container mouth and the cap end wall.

It is an object of this invention to provide a plastic closure capable of effecting an improved side seal and a top seal on the container mouth when the closure is applied to a container subjected to internal pressure. A typical use for a closure of this invention is for sealing a carbonated beverage in a bottle, for example.

This and other objects and advantages of this invention will be more fully understood and appreciated with reference to the following description of a preferred embodiment and accompanying drawings.

DESCRIPTION OF A PREFERRED EMBODIMENT

For convenience, a preferred embodiment of this invention is described with reference to a closure adapted for threadable assembly with a bottle. The subject invention is not limited to any particular kind of container or to any particular means for retaining the closure on a container. A closure of this invention is suitable for assembly with containers other than bottles and for assembly with containers by utilizing engaging means other than threads.

Figure 1:
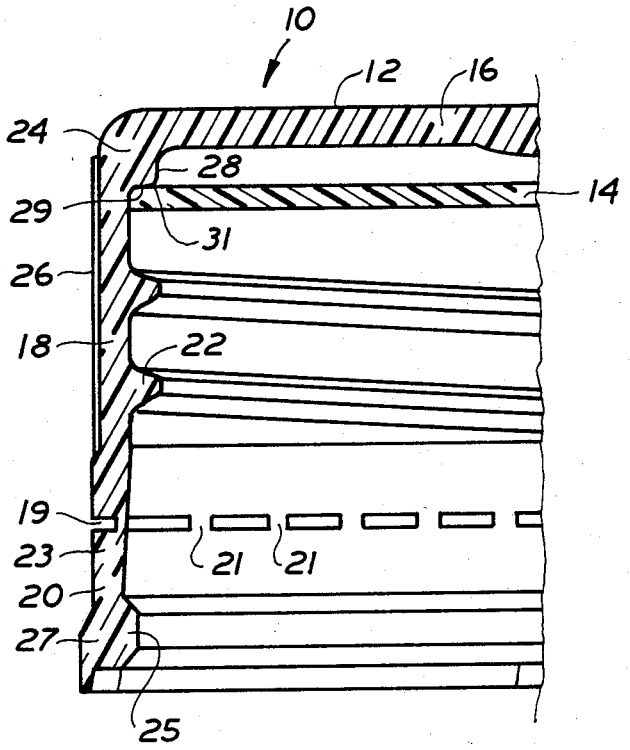
FIG. 1 is a partial cross section of a closure of this invention.

Referring to FIG. 1, a closure 10 of this invention comprises a plastic cap 12 and a plastic liner 14. The cap 12 is comprised of a circular planar end wall 16 and a skirt wall 18 depending from the outer edge of the end wall. The cap may also include a tamper-evident band 20 depending from the skirt wall, which will be discussed in greater detail later. A spiral screw thread 22 is provided on the interior surface of the skirt wall to threadably engage a container, as will be explained later. As used herein, the term "screw thread" is used to mean any closure retaining means, such as threads or lugs, for engagement between a closure and container by relative rotation to progressively interlock the closure and container and seal the same. Also included on the inner surface of the skirt wall 18 near the junction of the end wall 16 and skirt wall 18 is an annular shoulder 24 projecting radially inwardly into the closure, the shoulder having a substantially cylindrical sealing surface 28 extending downwardly from the end wall 16 and being substantially parallel to the outside sealing surface 36 on the bottle 30 with which the closure assembles, as may be seen in FIG. 2. The shoulder is further comprised of a substantially horizontal annular surface 29 projecting inwardly into the cap from the skirt 18, and an ironing corner 31 at the intersection of the cylindrical and horizontal surfaces. A plurality of outstanding ribs 26 on the outer surface of the skirt wall 18 provide a knurled surface for gripping the closure. Preferably the cap is made from high density polyethylene or polypropylene, but other formable plastic materials having sufficient hardness and rigidity to function in ironing the liner are suitable as well, as will be explained later.

As has been noted previously, a closure of this invention may include a tamper-evident band. In this preferred embodiment, the tamper-evident band 20 is comprised of an annular wall 23 depending from the cap skirt wall 18, a plurality of bridges 21 connecting the skirt wall and the annular wall, an annular rib 25 projecting into the interior of the closure from a portion of the annular wall near the distal end of the wall, and an outwardly flaring distal end portion 27 of the annular wall. As will be explained later, a tamper-evident band as just described is preferred because it enables a simple closure assembly with a bottle.

The plastic liner 14 is a disc disposed in the cap 10 in a zone between threads 22 and shoulder 24. The liner 14 preferably has a diameter sufficient to create an interference fit between the liner 14 and cap 12 to hold the liner in position prior to combining the closure with a container. The liner is preferably made from 9% EVA (ethyl vinyl acetate) polyethylene, but any other plastic material capable of being worked and deformed by the interaction of the cap and container upon assembly is satisfactory, as will be explained later.

Figure 2:
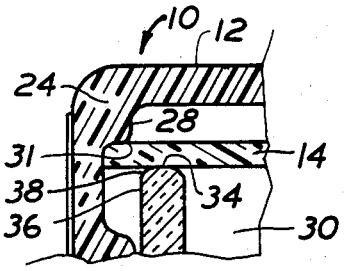
FIG. 2 is a partial cross section of the closure of FIG. 1 in an initial stage of assembly with a bottle with the rim surrounding the bottle mouth in initial contact with the closure liner.

In assembling the closure 10 with a bottle 30, the cap 12 is mechanically screwed onto the bottle in a conventional manner with cap thread 22 engaging the bottle thread 32. In FIG. 2 the bottle mouth rim 34 is shown making initial contact with liner 14 in the application cycle. In a typical closure of this invention, the inside diameter of the cylindrical sealing surface 28 will vary depending upon the finish of the bottle with which the closure is to be combined since the nominal outside diameter of the bottle adjacent the bottle mouth will vary depending upon the bottle material and the particular bottle manufacturer. It is apparent that the inside diameter of the cylindrical sealing surface 28 must be greater than the outside diameter adjacent to the mouth of the bottle with which the closure is to assemble in order that an assembly of the closure with the bottle can be made. The actual difference between such diameters, as opposed to the nominal difference, will vary depending primarily upon manufacturing tolerances in making the bottle. In any event, the dimensional relationships just discussed must be such to insure that a gap between the sealing surfaces 28, 36 of the cap and the bottle is always present and suitable to iron a portion of liner 14 and thus effect a side seal with a closure of this invention. The thickness of the liner 14, before the edge portion is ironed, must be thicker than the gap, regardless of variations in the gap due to manufacturing tolerances, to insure that the liner is reduced in thickness or ironed sufficiently to fill the gap completely including any irregularities in the gap distance due to tolerances or surface irregularities in the bottle finish. It has been determined that a liner having a nominal thickness that is reduced approximately 40 to 60% in filling the nominal gap can be thinned to such an extent without rupture and that such a reduction of the liner effects a satisfactory side seal.

Figure 3:
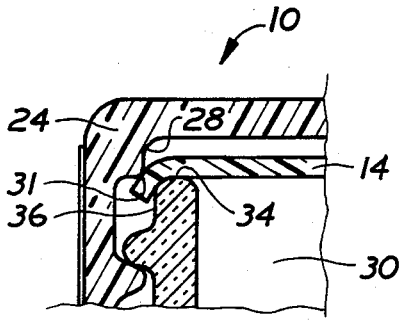
FIG. 3 is a partial cross section of the closure and bottle neck of FIG. 2 with the assembly of the closure and bottle partially completed.
Figure 4:
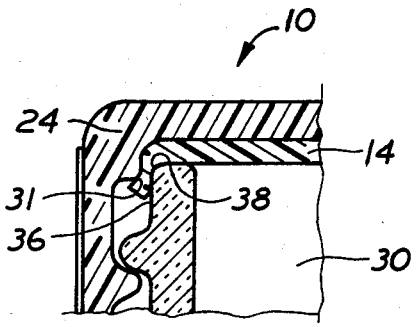
FIG. 4 is a partial cross section of the closure and bottle neck of FIG. 3 with the assembly of the closure and bottle partially completed.
Figure 5:
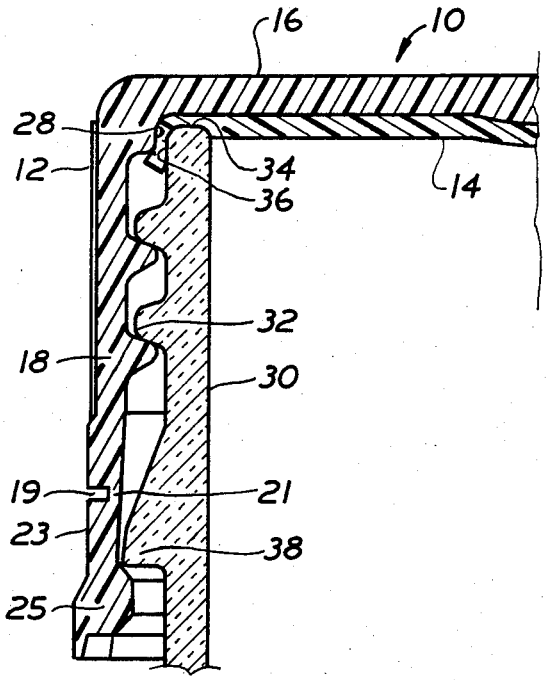
FIG. 5 is a partial cross section of a closure of this invention completely assembled with a bottle.

With reference to FIG. 3, it may be seen that in the initial stage of deforming the liner 14, the liner is drawn downward around the mouth of the bottle along its marginal edge by the axial movement of the closure relative to the bottle. As the closure 10 is progressively screwed onto the bottle 30, the liner 14 becomes pinched or squeezed between the ironing corner 31 of the shoulder 24 and the outer edge 38 of the mouth of the bgttle 30, as may be seen in FIG. 4. Since the liner 14 is made from a deformable plastic material that is more susceptible to yielding than either the cap 12 or bottle 30, the liner material is thinned and elongated in cross section from the ironing effect created by the downward movement of the cap ironing corner 31 relative to the bottle mouth edge 38 and the bottle side sealing surface 36. Because the liner is progressively thinned and elongated as it is ironed between the opposing sealing surfaces 28, 36 moving relative to one another, ironing is particularly advantageous in forcing the liner material to fill any irregularities in the bottle sealing surface 36. Continuous elongation and thinning of the liner thus progresses until the closure is completely assembled with the bottle, as shown in FIG. 5.

It may be seen that the elongation of the ironed portion is a function of the amount of liner material available for ironing, the amount that the liner is thinned during ironing and the lineal extent of the sealing surface 28 depending from the end wall 16. In general, the greater the lineal width of ironed liner that is squeezed between the closure and container sealing surfaces 28, 36, the greater the integrity of the side seal. It is preferable, however, that the width of the ironed side seal material be no greater than that considered necessary to maintain an effective side seal for a given size container and internal pressure within the sealed container in order that pressurized gas within the container may be vented as quickly as possible as the closure is being removed from the container. It is known that a premature disengagement of a closure from a container due to the internal pressure may occur for unforeseen reasons, such as unusually high pressures or misapplication of the closure, for example. Early venting of the pressurized gas affords a safeguard against such premature disengagement.

A satisfactory width of side seal can be determined without an undue amount of experimentation such as conducting a test program similar to that which will be described later.

Thus, by using a closure of this invention in assembly with a bottle, an effective side seal is achieved during a typical cycle of engaging the closure with the bottle. In addition to the improved side seal provided by the liner material being ironed between outer bottle surface 36 and inner cap surface 28, the liner is compressed between the bottle mouth 34 and the cap end wall 16. It is apparent that other means of engaging a closure of this invention with a container are suitable for effecting a side seal. A snap fit between the closure and container, for example, could provide the linear motion of the cap relative to the container to effect ironing a marginal portion of the liner.

As may also be seen in FIG. 5, the annular rib 25 of the tamper-evident band 20 is engaged with an annular locking shoulder 38 projecting outwardly from the bottle neck so as to prevent removal of the closure from the bottle without fracturing the bridges 21 connecting the skirt wall 18 and band wall 23. Engagement of rib 25 with bottle shoulder 38 is conveniently made during the typical application sequence of the closure to the bottle, as has just been described. As the closure is progressively screwed downward on the bottle during application, the rib 25 contacts the outwardly flaring upper surface of bottle shoulder 38, and the resilient nature of the plastic closure material permits the rib 25 to spring outward a distance sufficient to clear the shoulder 38 and then snap back into engagement with the shoulder, as shown in FIG. 5.

The cap portion 12 of a closure of this invention, either with or without the tamper-evident band described in this preferred embodiment, may be made using tooling known to those skilled in the art. The preferred method of making the cap 12 without the tamper-evident band is by the use of strip molds or screw-off type molds since use of such molds usually provides savings over the use of expandable molds. Whether a strip mold or screw-off mold is used may be a matter of choice or determined by certain dimensional or structural considerations. For example, if a relatively deep thread were considered necessary or desirable for a particular application of a closure of this invention, it might be necessary to use a screw-off mold to produce such a closure. Those skilled in the art could make a determination whether a particular embodiment of a cap in a closure of this invention could be produced with a strip or screw-off mold without undue experimentation being required.

If a tamper-evident band is included in a closure of this invention, it may be necessary to use radially expandable molds. However, a closure of this invention having the tamper-evident band shown in FIG. 5 and described in connection with this preferred embodiment may be made with strip mold or screw-off mold equipment, because the bridges 21 connecting the tamper-evident band 20 to the skirt wall 18 are provided by cutting away a portion of the skirt wall after molding the closure. By reference to FIG. 6, which shows a cap portion of this invention as molded, it may be seen that the skirt wall 18 of the cap 12 includes no weakened portion between the threads 22 and the annular rib 25. It would be understood by those skilled in the art that such a cap may be produced with either strip molds or screw-off type molds, depending upon the depth of the thread 22 and rib 25.

Figure 6:
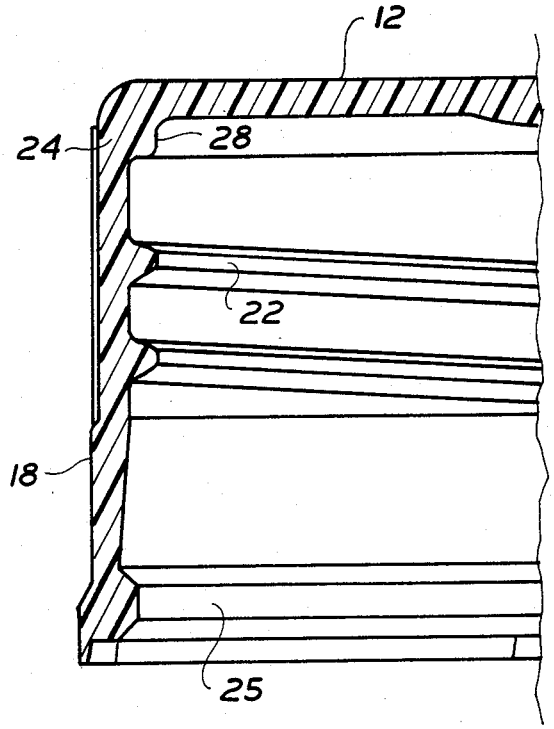
FIG. 6 is a cross section of the cap of a closure of this invention in an as-molded condition.

The weakened portion of the cap 12 comprised of an annular groove 19 and bridges 21 connecting the tamper-evident band 20 to the cap skirt wall 18, as shown in FIG. 1, is provided after forming the cap, as shown in FIG. 6. The groove 19 and connecting bridges 21 may be provided, for example, by using a rotating cutter such as that employed in making a weakened portion in a metal closure having a tamper-evident band incorporated therein.

The following example is a description of a test program which is offered as a demonstration of the effectiveness of a closure of this invention in maintaining a seal between a closure and a bottle having a carbonated beverage therein.

In this program, a carbonated soft drink beverage was packaged in conventional two-liter PET (Polyethylene Terephthalate) plastic bottles having a 1716 finish thereon for engagement with a closure of this invention. 28-mm closures of this invention which included tamper-evident bands, as shown in FIG. 1, were used to package the carbonated beverage in the above-described bottles. The cap portion of the closures was made from polypropylene and the liner of the closures was made from 9% EVA (ethyl vinyl acetate). The diameter and thickness of the liner and dimensional values of the closure employed in making the foregoing assemblies were adapted to produce an ironed side seal liner portion approximately 55% of the nominal thickness of the liner before ironing and a linear width of 0.015 inch. The closures were applied to the filled beverage bottles using conventional capping machines at test locations at Minneapolis, Minn. and Cheraw, S.C.

At periodic intervals, a number of bottles selected at random from the bottles originally filled and sealed were checked for torque required to remove the closure, the internal pressure within the sealed bottle at the time of closure removal, and the temperature of the storage area at the time the closure was removed. From the internal pressure and temperature values, a volume multiplier was determined which was used to establish the compressed volume of gas within the container expressed as the volume the gas would occupy at normal atmospheric pressure. For example, after the first week the Minneapolis bottles had an internal pressure which varied from 54–59 lbs./in.$^2$ at a temperature of 80° F, and the volume multiplier for those pressures at that temperature varies from 3.4 to 3.6. In the two-liter bottles tested, therefore, the volume of gas at normal atmospheric pressure contained within those bottles varied from 6.8 to 7.2 liters.

At Minneapolis, 16 bottles were checked periodically and at Cheraw, S.C., 12 bottles were checked periodically. Listed below are average values from the recorded values for the number of bottles checked at weekly intervals during the course of the test.

| Time of check after packaging, wks. | Avg. Removal Torque, in. lbs. | Pressure Range, psi | Vol. Range, atmospheres | Avg. Vol. | Avg. Temp., °F. |
|---|---|---|---|---|---|
| | | Minneapolis Test | | | |
| 1 | 18.1 | 54–59 | 3.4–3.6 | 3.57 | 80 |
| 2 | 19.4 | 52–56 | 3.4–3.6 | 3.55 | 78 |
| 3 | | 48–52 | 3.4–3.6 | 3.49 | 75 |
| 4 | | 54–61 | 3.1–3.5 | 3.37 | 85 |
| 6 | | 53–57 | 3.3–3.5 | 3.36 | 82 |
| 8 | | 47–49 | 3.3–3.4 | 3.34 | 75 |
| 12 | | 40–46 | 2.8–3.1 | 3.0 | 76 |
| | | Cheraw Test | | | |
| 3 | 11.5 | 50–52 | 3.5–3.6 | 3.55 | 74 |
| 4 | 14.7 | 50–51 | 3.4–3.5 | 3.43 | 76 |
| 6 | 10.8 | 50–51 | 3.3–3.4 | 3.36 | 77 |
| 8 | 12.3 | 48–49 | 3.3–3.4 | 3.35 | 76 |
| 12 | 12.7 | 46–47 | 3.0–3.1 | 3.03 | 79 |

It should be noted that the gradual reduction in volume during the course of time in which values were recorded was not unexpected since PET bottles are permeable and a loss of volume of a carbonated beverage packaged in such a bottle may occur regardless of the closure system employed.

In all respects, the above test program was considered to have been successful and demonstrate the effectiveness of a closure of this invention in providing a seal for a bottle containing a carbonated beverage.

While a particular embodiment has been illustrated and described for use in this invention, it will be apparent to those skilled in the art that various changes and modifications can be made without departing from the scope of the invention and the claims appended hereto.

What is claimed is:

1. A plastic closure for fitment to a container having a threaded neck terminating in a rim which defines an open mouth, said closure comprising:

(a) a circular end wall;

(b) an annular skirt downwardly depending from said end wall having a closure thread formed about an inside surface thereof which cooperates with said threaded neck of said container to achieve said fitment;

(c) a circular, deformable liner positioned adjacent to said end wall and having a diameter greater than the outside diameter of said rim; and (d) annular means for squeezing said liner around the exterior surface of said neck to form a gas-tight side seal when said closure is fitted on said container, said annular means located adjacent to the inside intersection of said end wall and said skirt and including a vertical portion and a convex corner connecting said vertical portion to the inside surface of said skirt therebelow, whereby as said closure is progressively threadably secured to said container, said liner is squeezed and linearly deformed between said convex corner and the exterior surface of said neck to form said side seal, said side seal occurring below the outside radius of said rim and said annular means increasing the fidelity of said gas-tight seal when said circular top wall is flexed upwardly.

2. The plastic closure of claim 1 wherein said annular means comprises an annular shoulder having a convex corner, said convex corner cooperating with the exterior surface of said container neck, below the outside radius of said rim, to squeeze and linearly deform said liner thereby producing a side seal as said closure is securely threaded to said container.

3. The plastic closure of claim 2 wherein the distance between the exterior surface of said neck and said annular shoulder is substantially less than the initial thickness of said liner.

4. The plastic closure of claim 2 wherein said closure is made of polypropylene.

5. The plastic closure of claim 2 wherein said liner is made from ethylene-vinyl acetate.

6. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip; and d. annular means for pressing said liner around the outside edge of said lip to form a gas-tight seal when said closure is fitted on said container, said annular means being located adjacent the inside intersection of said top wall and said skirt, said annular means having a configuration, when viewed in cross-section, which has a horizontal portion, a vertical portion and a convex portion, said convex portion connecting said horizontal portion and said vertical portion one to the other, whereby said annular means increases the fidelity of said gas-tight seal when said circular top wall is flexed upwardly.

7. The closure of claim 6 wherein said closure is made of polypropylene.

8. The closure of claim 7 wherein said liner is an ethylene-vinyl acetate copolymer.

9. The closure of claim 6 wherein said liner is an ethylene-vinyl acetate copolymer.

10. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip; and d. an annular convex bead for pressing said liner around the outside edge of said lip to form a gas-tight seal when said closure is fitted on said container, said annular convex bead being located adjacent the inside section of said top wall and said skirt, whereby said annular convex bead increases the fidelity of said gas-tight seal when said circular top wall is flexed upwardly.

11. The closure of claim 10 wherein said closure is made of polypropylene.

12. The closure of claim 11 wherein said liner is an ethylene-vinyl acetate copolymer.

13. The closure of claim 10 wherein said liner is an ethylene-vinyl acetate copolymer.

14. A thermoplastic closure for fitment to a container having a threaded neck terminating in a lip which defines an open mouth, said closure comprising:

a. a circular top wall;

b. a skirt downwardly depending from said top wall having an internal thread formed thereon for cooperation with said threaded neck of said container;

c. a circular liner positioned adjacent to said top wall and having a diameter greater than the outside diameter of said lip; and d. annular means for pressing said liner around the outside edge of said lip to form a gas-tight seal when said closure is fitted on said container, said annular means being located adjacent to the inside intersection of said top wall and said skirt, said annular means having a configuration, when viewed in cross-section, which has a horizontal portion, a vertical portion and a convex portion, said convex portion connecting said horizontal portion to said vertical portion and being located below said lip when said closure is secured to said container, whereby said annular means increases the fidelity of said gas-tight seal when said circular top wall is flexed upwardly.

15. The closure of claim 14 wherein said closure is made of polypropylene.

16. The closure of claim 15 wherein said liner is an ethylene-vinyl acetate copolymer.

17. The closure of claim 14 wherein said liner is an ethylene-vinyl acetate copolymer.

18. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip; and d. an annular convex bead for pressing said liner around the outside edge of said lip to form a gas-tight seal when said closure is fitted on said container, said annular convex bead being located below the inside section of said top wall and said skirt, whereby said annular convex bead increases the fidelity of said gas-tight seal when said circular top wall is flexed upwardly.

19. The closure of claim 18 wherein said closure is made of polypropylene.

20. The closure of claim 19 wherein said liner is an ethylene-vinyl acetate copolymer.

21. The closure of claim 18 wherein said liner is an ethylene-vinyl acetate copolymer.

22. A thermoplastic closure for sealing an open mouth of a container having closure engaging means formed on a sidewall surrounding said open mouth, a cylindrical side sealing surface on a sidewall portion adjacent to said open mouth, and a top sealing surface on a rim of said container, said closure comprising:

(a) a circular top wall;

(b) a skirt downwardly depending from said end wall having container engaging means formed on an interior surface thereof which cooperates with said closure engaging means formed on said container;

(c) a circular liner positioned adjacent to said end wall and above said closure engaging means which is capable of being reduced in thickness, said liner having a diameter greater than the outside diameter of said open mouth of said container; and (d) ironing means for squeezing said liner against said side sealing surface of said container to produce a side seal while being spaced apart therefrom a distance less than the thickness of said liner, whereby said ironing means increases the fidelity of said side seal when said end wall is flexed upwardly.

23. The closure of claim 22 wherein said ironing means includes an annular shoulder projecting inwardly into said cap near the intersection of said end wall and said skirt, said annular shoulder having a cylindrical surface depending downwardly from said end wall, an annular surface projecting inward from said skirt, and a corner formed at the intersection of said cylindrical and annular surfaces.

24. The closure of claim 23 wherein the diameter of said cylindrical surface is no greater than the diameter of said cylindrical side sealing surface of said container plus approximately 120% of the thickness of said liner before said liner is reduced in thickness.

25. A thermoplastic closure for sealing a container having an open mouth defined by a cylindrical wall having a side sealing surface located on an outside surface of said cylindrical wall and adjacent to said rim and closure engaging means formed on said cylindrical wall, said closure comprising:

(a) a cylindrical end wall;

(b) a skirt downwardly depending from said end wall having container engaging means formed on an interior surface thereof for engagement with said closure engaging means formed on said container;

(c) an annular shoulder formed at the junction of said end wall and said skirt having a horizontal surface extending inwardly from said skirt, a cylindrical sealing surface downwardly depending from said end wall and parallel therewith, said sealing surface being spaced apart from said side sealing surface of said container, and a corner formed at the intersection of said horizontal and cylindrical surfaces and below said rim when said closure is secured to said container; and (d) a liner positioned adjacent to said end wall and having a diameter greater than the outside diameter of said rim, said liner having a central portion, an annular top seal portion located radially outward from said central portion, and a side seal portion downwardly depending from said top seal portion when said closure is secured to said container, said central portion having a thickness greater than the width of the space formed between said cylindrical sealing surface and said side sealing surface of said container, said top seal portion being compressed between said rim and an annular portion of said end wall to a thickness less than the thickness of said central portion to provide a top seal, and said side seal portion having a thickness less than said central portion of said liner and confined in the space between said cylindrical sealing surface and said side sealing surface of said container as a result of said corner engaging a marginal portion of said liner adjacent to an edge thereof and thinning and elongating such marginal portion as said corner moves linearly parallel to said side sealing surface of said container during engagement of said closure to provide a side seal whereby said annular shoulder increases the fidelity of said side seal when said end wall is flexed upwardly.

26. The closure of claim 25 wherein the thickness of said side seal is less than 60% of the thickness of said central portion of said liner.

27. A thermoplastic closure for sealing an open mouth of a threaded container having a cylindrical side surface formed on an exterior portion of said open mouth, and a top sealing surface on a rim of said container, said closure comprising:

(a) an end wall;

(b) a skirt downwardly depending from said end wall having a thread projecting inwardly therefrom for engaging said threaded container;

(c) an annular shoulder formed at the juncture of said end wall and said skirt having a cylindrical surface downwardly depending from said end wall, a horizontal annular surface extending inwardly from said skirt, and a corner formed at the juncture of said cylindrical surface and said horizontal annular surface below said rim of said container;

(d) a tamper-evident band connected to said skirt by frangible means; and (e) a circular liner positioned adjacent to said end wall between said thread and said horizontal annular surface, said liner having a diameter approximately equal to the inside diameter of said skirt, and the diameter of said cylindrical surface being no greater than the diameter of said cylindrical side surface of said container plus 120% of the thickness of said liner before said liner is reduced in thickness whereby said annular shoulder increases the fidelity of a seal formed between said cylindrical surface of said cap and said cylindrical side surface of said container when said end wall is flexed upwardly.

* * * * *